US005938568A

United States Patent [19]

Maresh et al.

[11] Patent Number: 5,938,568

[45] Date of Patent: Aug. 17, 1999

[54] EXERCISE METHODS AND APPARATUS

[76] Inventors: Joseph D. Maresh, P.O. Box 645, West Linn, Oreg. 97068-0645; Kenneth W. Stearns, P.O. Box 55912, Houston, Tex. 77055

[21] Appl. No.: 09/065,309

[22] Filed: Apr. 23, 1998

Related U.S. Application Data

[60] Provisional application No. 60/044,026, May 5, 1997.

[51] Int. Cl.[6] ..... A63B 22/06

[52] U.S. Cl. ..... 482/51; 482/57; 482/70

[58] Field of Search ..... 482/51, 52, 53, 482/57, 70, 71, 79, 80, 95–96

[56] References Cited

U.S. PATENT DOCUMENTS

| | | | |
|---|---|---|---|
| 5,242,343 | 9/1993 | Miller | 482/57 |
| 5,346,447 | 9/1994 | Stearns | 482/95 |
| 5,499,956 | 3/1996 | Habing et al. | 482/51 |
| 5,549,526 | 8/1996 | Rodgers | 482/52 |
| 5,653,662 | 8/1997 | Rodgers | 482/70 |
| 5,658,225 | 8/1997 | Huang | 482/96 |
| 5,685,804 | 11/1997 | Whan-Tong et al. | 482/51 |
| 5,762,588 | 6/1998 | Chen | 482/57 |
| 5,823,917 | 10/1998 | Chen | 482/51 |

*Primary Examiner*—Stephen R. Crow

[57] ABSTRACT

An exercise apparatus includes a foot supporting member having a first end rotatably connected to a crank and a second, opposite end supported by a roller which is selectively movable in a radial direction.

9 Claims, 4 Drawing Sheets

Fig. 1
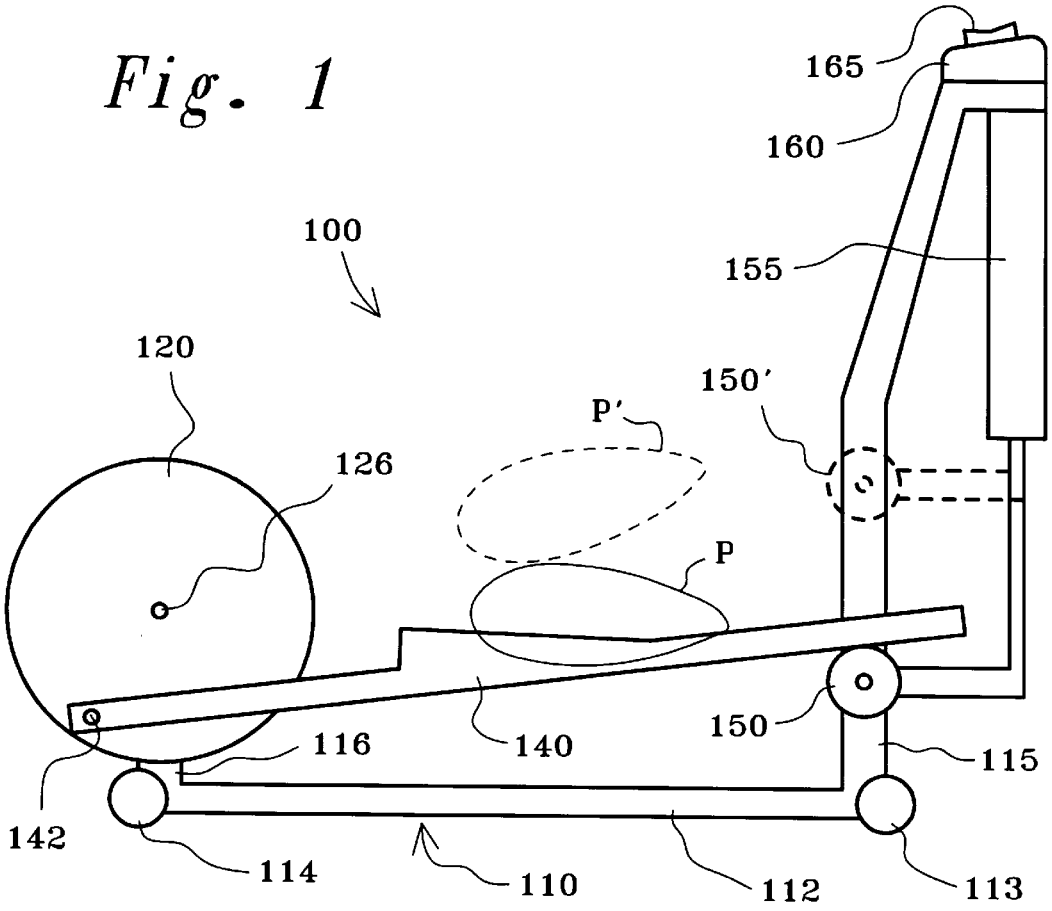
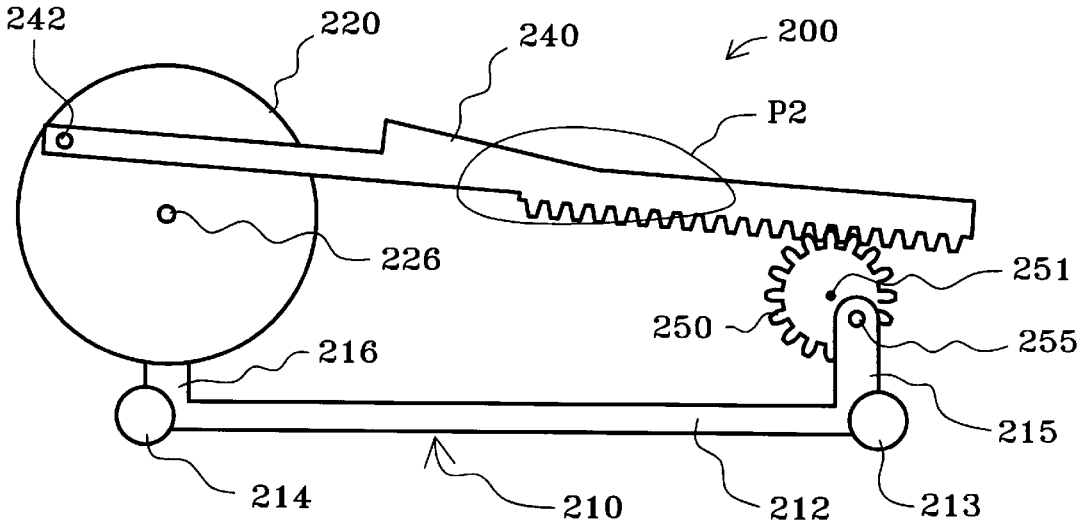
Fig. 2

EXERCISE METHODS AND APPARATUS

CROSS-REFERENCE TO RELATED APPLICATIONS

This application discloses subject matter entitled to the earlier filing date of U.S. Provisional Application Ser. No. 60/044,026, filed on May 5, 1997.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. One example of such equipment may be found in U.S. Pat. No. 3,316,898 to Brown. Subsequent advances in the art have facilitated additional foot motions and/or added upper body exercise, but room remains for additional improvements to machines of this type.

SUMMARY OF THE INVENTION

The present invention may be seen to provide a novel linkage assembly and corresponding exercise apparatus suitable for linking circular motion to relatively more complex, generally elliptical motion. In at least one embodiment, a first end of a foot supporting member is rotatably connected to a crank, and a second, opposite end of the foot supporting member is supported by a roller which is selectively movable in a radial direction. The arrangement is such that rotation of the crank is linked to generally elliptical motion of an intermediate portion of the foot supporting member, and the motion is variable in response to radial movement of the roller.

In another respect, the present invention may be seen to provide a novel linkage assembly and corresponding exercise apparatus suitable for linking reciprocal motion to relatively more complex, generally elliptical motion. In at least one embodiment, the forward end of the foot supporting member is connected to a lower end of a rocker link having an upper end which is sized and configured for grasping. The arrangement is such that generally elliptical motion of the intermediate portion of the foot supporting member is linked to pivoting of the rocker link.

In yet another respect, the present invention may be seen to provide a novel linkage assembly and corresponding exercise apparatus suitable for adjusting the angle of the generally elliptical path of motion relative to a horizontal surface on which the apparatus rests. In at least one embodiment, the roller is movable up and down relative to the crank axis to change the inclination of the generally elliptical path of motion. Many of the advantages of the present invention may become more apparent from the detailed description that follows.

BRIEF DESCRIPTION OF THE DRAWING

With reference to the Figures of the Drawing, wherein like numerals represent like parts and assemblies throughout the several views, FIG. 1 is a side view of a first exercise apparatus constructed according to the principles of the present invention;

FIG. 2 is a side view of a second exercise apparatus constructed according to the principles of the present invention;

DETAILED DESCRIPTION OF THE PREFERRED EMBODIMENT

Figure 3:
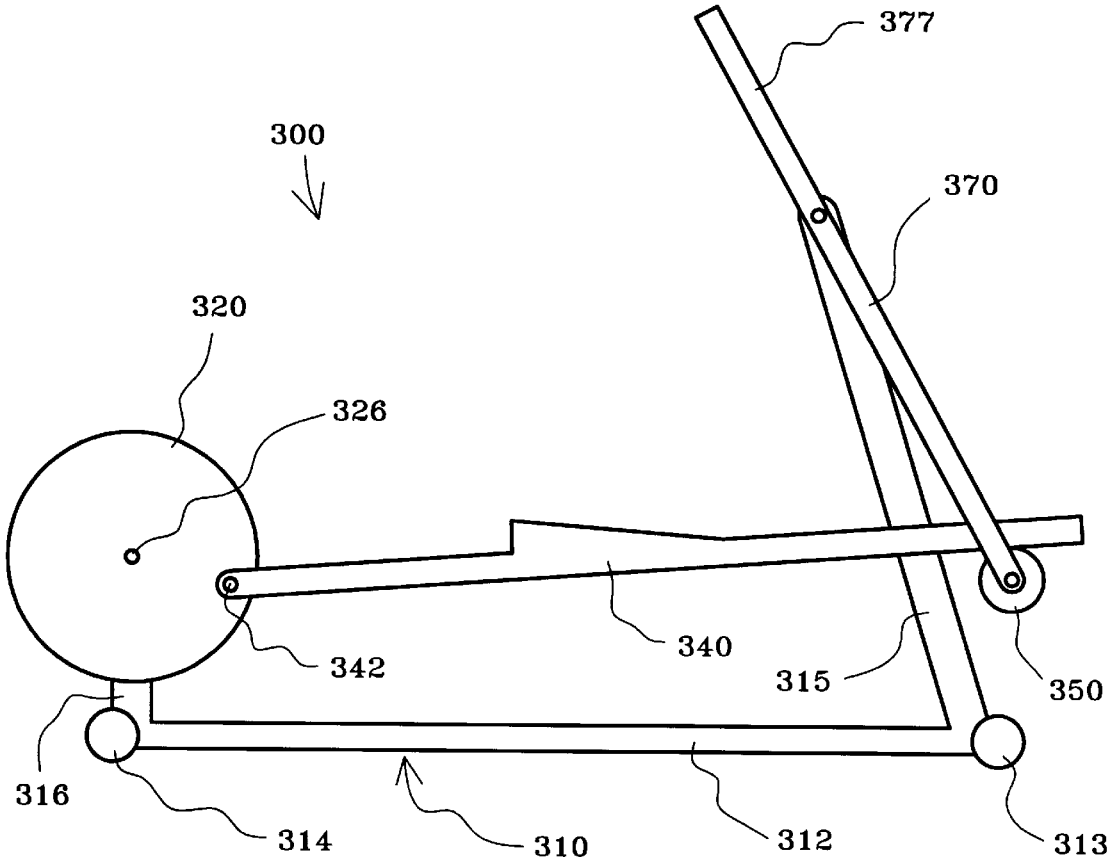
FIG. 3 is a side view of a third exercise apparatus constructed according to the principles of the present invention.

Several embodiments of the present invention are described below with reference to the accompanying drawings. On each embodiment, a linkage assembly moves relative to a frame in a manner that links rotation of a crank to generally elliptical motion of a foot supporting member. The term "elliptical motion" is intended in a broad sense to describe a closed path of motion having a relatively longer first axis and a relatively shorter second axis (which extends perpendicular to the first axis).

Each frame includes a base which may be described as generally I-shaped and designed to rest upon a generally horizontal floor surface. Each apparatus is generally symmetrical about a vertical plane extending lengthwise through the base (perpendicular to the transverse members at each end thereof), the only exception being the relative orientation of linkage assembly components on opposite sides of the plane of symmetry. In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, the portions of the frame which are intersected by the plane of symmetry exist individually and thus, do not have any "opposite side" counterparts. Moreover, to the extent that reference is made to forward or rearward portions, it is to be understood that a person could exercise while facing in either direction relative to the linkage assembly.

A first exercise apparatus constructed according to the principles of the present invention is designated as 100 in FIG. 1. The apparatus has a frame 110 which includes an I-shaped base 112; a forward stanchion or upright 115 which extends upward from the base 112 proximate a first end 113 thereof; and a rearward stanchion or upright 116 which extends upward from the base 112 proximate a second, opposite end 114 thereof.

Left and right flywheels 120 are rotatably mounted on opposite sides of the rearward stanchion 116 and rotate together about a common crank axis 126. Those skilled in the art will recognize that the flywheels 120 may be connected to a conventional resistance device or replaced by some other rotating member(s) which may or may not, in turn, be connected to one or more flywheels and/or a conventional resistance device.

Left and right foot supporting members 140 have rear ends which are rotatably connected to radially displaced portions of respective cranks 120, thereby defining rotational axes 142. The rotational axes 142 are constrained to rotate about the crank axis 126 and thereby define fixed crank radii.

An intermediate portion of each foot supporting member 140 is sized and configured to support a respective foot of a standing person. A forward end of each foot supporting member 140 is supported by a respective roller 150 which rotates relative to the frame 110. More specifically, an adjustable length member 155 is rigidly mounted on the forward stanchion 115, and the rollers 150 are rotatably mounted on a selectively movable portion of the adjustable length member 155. When the roller 150 occupies the position shown in solid lines in FIG. 1, rotation of the crank 120 is linked to movement of a person's feet move through the generally elliptical path designated as P.

A user accessible device 160 is mounted on top of the forward stanchion 115 to provide information regarding and/or facilitate adjustment of exercise parameters. For example, a button 165 may be depressed to change the length of the adjustable length member 155 and thereby reposition the rollers 150 relative to the crank axis 126. As suggested by the roller 150' and path P' shown in dashed lines in FIG. 1, relatively higher rollers results in a relatively more "uphill" exercise.

A second exercise apparatus constructed according to the principles of the present invention is designated as 200 in FIG. 2. The apparatus has a frame 210 which includes an I-shaped base 212; a forward stanchion or upright 215 which extends upward from the base 212 proximate a first end 213 thereof; and a rearward stanchion or upright 216 which extends upward from the base 212 proximate a second, opposite end 214 thereof.

Left and right flywheels 220 are rotatably mounted on opposite sides of the rearward stanchion 216 and rotate together about a common crank axis 226. Those skilled in the art will recognize that the flywheels 220 may be connected to a conventional resistance device or replaced by some other rotating member(s) which may or may not, in turn, be connected to one or more flywheels and/or a conventional resistance device.

Left and right foot supporting members 240 have rear ends which are rotatably connected to radially displaced portions of respective cranks 220, thereby defining rotational axes 242. The rotational axes 242 are constrained to rotate about the crank axis 226 and thereby define fixed crank radii.

An intermediate portion of each foot supporting member 240 is sized and configured to support a respective foot of a standing person. A forward end of each foot supporting member 240 is supported by a respective roller 250 which rotates relative to the frame 210. Each roller 250 is a circular gear 250 having a geometric center 251 and gear teeth disposed about its circumference, and an eccentric portion of each roller 250 is rotatably mounted to the forward stanchion 215, thereby defining rotational axes 255. Mating rack gear teeth extend downward from the forward end of each foot supporting member 240 and engage the teeth on a respective gear 250. The gear teeth prevent slippage of either foot supporting member relative to a respective roller 250. The resulting foot path is designated as P2 in FIG. 2. Inclination adjustment may be added as a matter of design choice.

A third exercise apparatus constructed according to the principles of the present invention is designated as 300 in FIG. 3. The apparatus has a frame 310 which includes an I-shaped base 312; a forward stanchion or upright 315 which extends upward from the base 312 proximate a first end 313 thereof; and a rearward stanchion or upright 316 which extends upward from the base 312 proximate a second, opposite end 314 thereof.

Left and right flywheels 320 are rotatably mounted on opposite sides of the rearward stanchion 316 and rotate together about a common crank axis 326. Those skilled in the art will recognize that the flywheels 320 may be connected to a conventional resistance device or replaced by some other rotating member(s) which may or may not, in turn, be connected to one or more flywheels and/or a conventional resistance device.

Left and right foot supporting members 340 have rear ends which are rotatably connected to radially displaced portions of respective cranks 320, thereby defining rotational axes 342. The rotational axes 342 are constrained to rotate about the crank axis 326 and thereby define fixed crank radii.

An intermediate portion of each foot supporting member 340 is sized and configured to support a respective foot of a standing person. A forward end of each foot supporting member 340 is supported by a respective roller 350 which is rotatably mounted on a lower end of a respective handle bar rocker link 370. An intermediate portion of each rocker link 370 is rotatably connected to the forward stanchion 315, and an upper end of each rocker link 370 is sized and configured for grasping.

The resulting assembly facilitates several different exercise modes or routines. In a first routine, for example, a user may maintain the handle bar rocker links 370 in a vertical orientation while moving his feet through fixed elliptical paths of motions. In a second routine, for example, a user may maintain the handle bar rocker links 370 in rearwardly tilted orientations while moving his feet through fixed elliptical paths of motion which are relatively more upwardly inclined. In a third routine, for example, a user may move the handle bar rocker links 370 while moving his feet through paths of motion which vary in accordance with the motion of the rocker links 370.

The apparatus 300 may be modified in a variety of ways to facilitate additional exercise modes. For example, the rocker links 370 may be selectively pinned to the forward stanchion 315 to provide a stationary support which does not require physical exertion to remain in place. Also, the rocker links 370 may be selectively pinned in various orientations relative to the forward stanchion 315 to provide different handle orientations and inclinations of foot travel. Moreover, the rocker links 370 may be rigidly connected to one another so that they pivot together relative to the forward stanchion 315. Furthermore, the rocker links 370 may be "cross-coupled" so that they are constrained to pivot in opposite directions relative to the forward stanchion 315.

Figure 4:
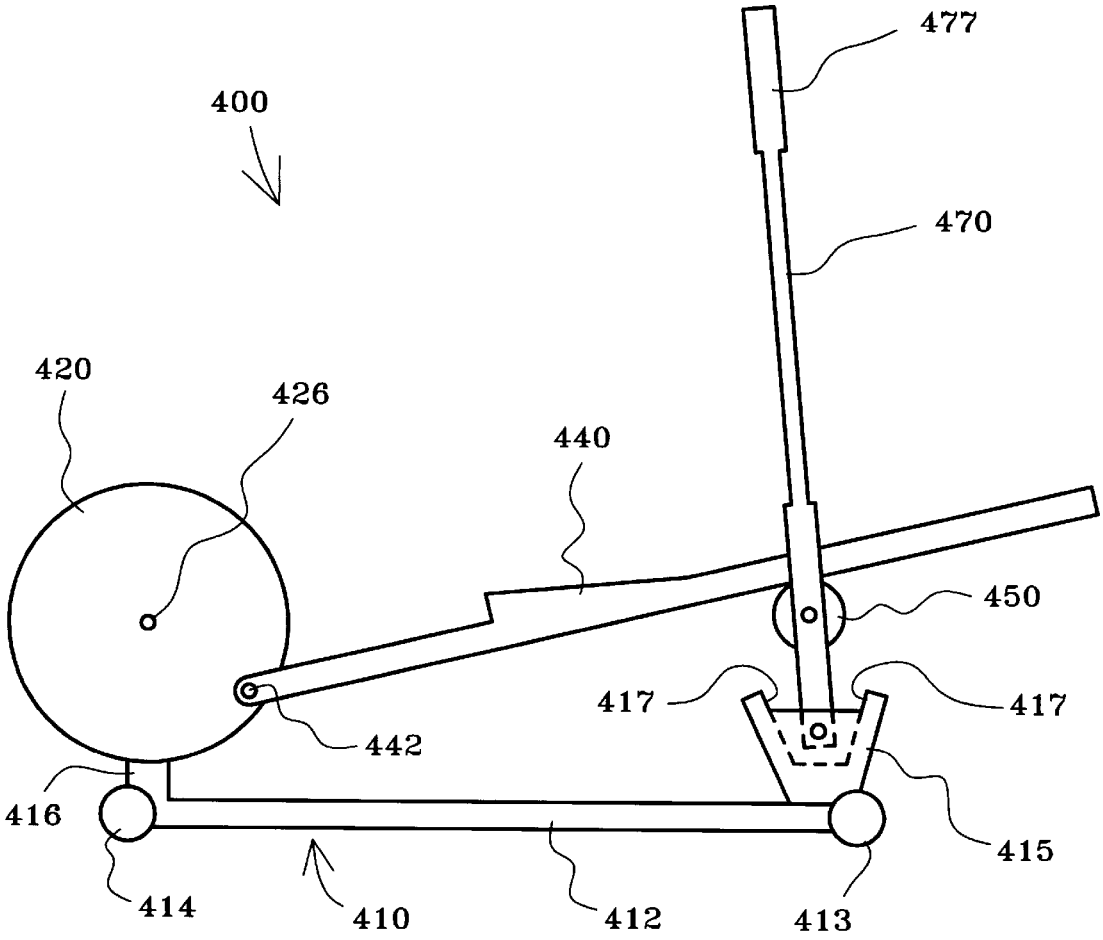
FIG. 4 is a side view of a fourth exercise apparatus constructed according to the principles of the present invention.

A fourth exercise apparatus constructed according to the principles of the present invention is designated as 400 in FIG. 4. The apparatus has a frame 410 which includes an I-shaped base 412; a forward stanchion or upright 415 which extends upward from the base 412 proximate a first end 413 thereof; and a rearward stanchion or upright 416 which extends upward from the base 412 proximate a second, opposite end 414 thereof.

Left and right flywheels 420 are rotatably mounted on opposite sides of the rearward stanchion 416 and rotate together about a common crank axis 426. Those skilled in the art will recognize that the flywheels 420 may be connected to a conventional resistance device or replaced by some other rotating member(s) which may or may not, in turn, be connected to one or more flywheels and/or a conventional resistance device.

Left and right foot supporting members 440 have rear ends which are rotatably connected to radially displaced portions of respective cranks 420, thereby defining rotational axes 442. The rotational axes 442 are constrained to rotate about the crank axis 426 and thereby define fixed crank radii.

An intermediate portion of each foot supporting member 440 is sized and configured to support a respective foot of a standing person. A forward end of each foot supporting member 440 is supported by a respective roller 450 which is rotatably mounted on an intermediate portion of a respective handle bar rocker link 470. A lower end of each rocker link 470 is rotatably connected to the forward stanchion 415, and an upper end of each rocker link 470 is sized and configured for grasping. Stops 417 are provided on the forward stanchion 415 to limit pivoting of the rocker links 470 relative thereto. This assembly also facilitates different types of exercises.

Figure 5:
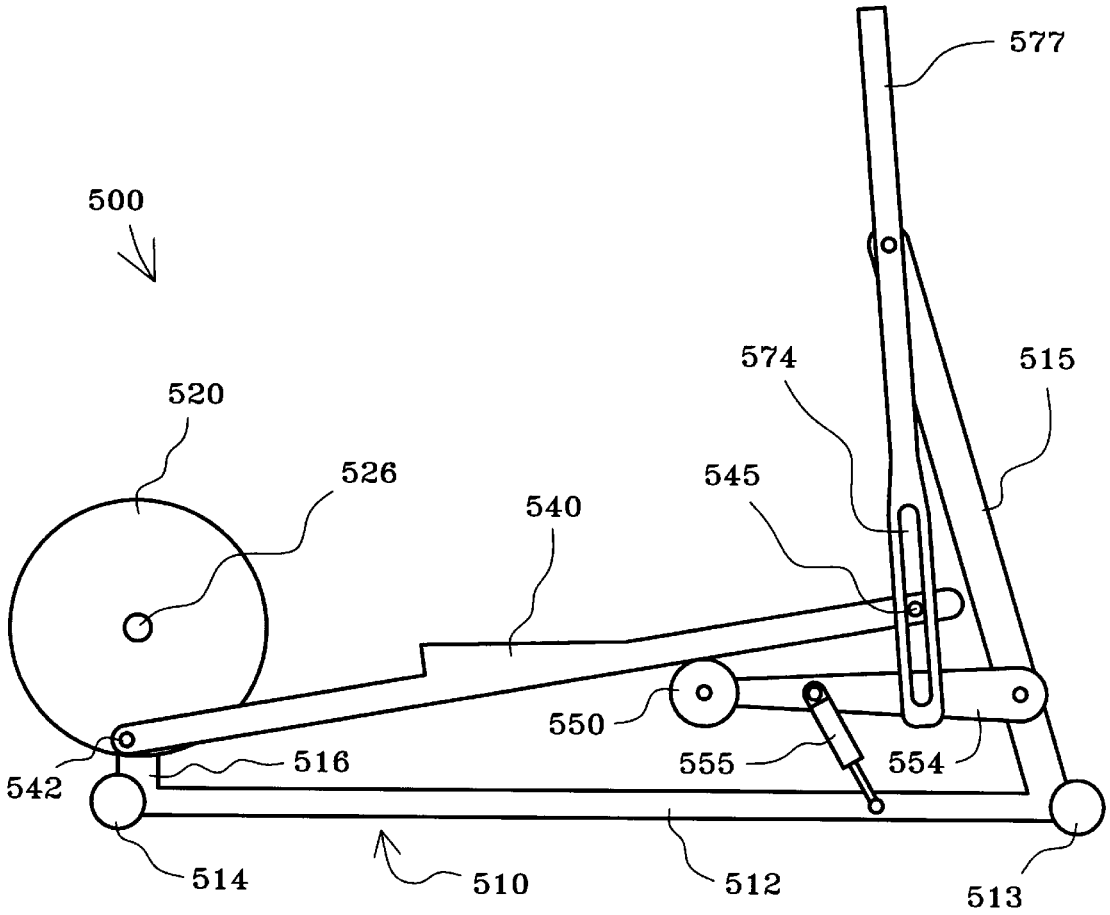
FIG. 5 is a side view of a fifth exercise apparatus constructed according to the principles of the present invention.

A fifth exercise apparatus constructed according to the principles of the present invention is designated as 500 in FIG. 5. The apparatus has a frame 510 which includes an I-shaped base 512; a forward stanchion or upright 515 which extends upward from the base 512 proximate a first end 513 thereof; and a rearward stanchion or upright 516 which extends upward from the base 512 proximate a second, opposite end 514 thereof.

Left and right flywheels 520 are rotatably mounted on opposite sides of the rearward stanchion 516 and rotate together about a common crank axis 526. Those skilled in the art will recognize that the flywheels 520 may be connected to a conventional resistance device or replaced by some other rotating member(s) which may or may not, in turn, be connected to one or more flywheels and/or a conventional resistance device.

Left and right foot supporting members 540 have rear ends which are rotatably connected to radially displaced portions of respective cranks 520, thereby defining rotational axes 542. The rotational axes 542 are constrained to rotate about the crank axis 526 and thereby define fixed crank radii.

Each foot supporting member 540 has an intermediate portion which is sized and configured to support a respective foot of a standing person, and which is supported from beneath by a respective roller 550. Each roller 550 is rotatably mounted on a distal end of a respective beam 554 having an opposite end rotatably connected to the forward stanchion 515. A single actuator 555 is rotatably interconnected between the base 512 and an intermediate portion of the beam 554. The actuator 555 is selectively operable to adjust the elevation of the roller 550 relative to the crank axis 526.

Each foot supporting member 540 has a forward end which is rotatably and slidably connected to a respective handle bar rocker link 570. In particular, on each side of the apparatus 500, a pin 545 extends through a hole in the foot supporting member 540 and a slot 574 in the rocker link 570. An intermediate portion of each rocker link 570 is rotatably connected to the forward stanchion 515, and an upper end of each rocker link 570 is sized and configured for grasping.

Upper body exercise may be provided by other arrangements, as well. For example, handle bars may be pivotally mounted on the frame and movable independent of the foot supporting members and/or any underlying roller; or handle bars may be rigidly secured to the foot supporting members rather than rotatably mounted on the frame. Also, the orientation of the path traveled by the force receiving members may be adjusted in other ways, as well. For example, an upper stanchion member may move relative to a lower stanchion member and be secured in place by a detent pin arrangement or a lead screw assembly.

In conclusion, the present invention has been described with reference to particular embodiments and applications, but those skilled in the art will recognize additional embodiments, modifications, and/or applications which fall within the scope of the present invention. Also, design considerations may lead to a variety of conventional modifications, such as the addition of inertia altering devices, including, for example, a motor, a "stepped up" flywheel, or an adjustable brake of some sort, and/or the restructuring of parts and/or assemblies, including, for example, rotatably interconnecting components so that an end of a first component is nested between opposing prongs on the end of a second component. Therefore, the scope of the present invention is to be limited only to the extent of the claims which follow.

What is claimed is:

1. An exercise apparatus, comprising:

a frame sized and configured to rest upon a horizontal floor surface;

left and right cranks rotatably mounted on the frame and rotatable about a common crank axis;

left and right rollers rotatable relative to the frame and selectively movable in a plane extending perpendicular to the crank axis; and left and right foot supports having first portions rotatably connected to respective cranks, and second portions disposed on top of respective rollers, and third portions sized and configured to support respective feet of a person, wherein said foot supports are movable in both rotational and translational fashion relative to said respective rollers.

2. The exercise apparatus of claim 1, wherein the rollers are rotatably mounted on respective rocker links which are pivotally mounted on the frame.

3. The exercise apparatus of claim 2, wherein upper ends of the rocker links are sized and configured for grasping.

4. An exercise apparatus, comprising:

a frame sized and configured to rest upon a horizontal floor surface;

left and right cranks rotatably mounted on the frame and rotatable about a common crank axis;

left and right rollers rotatable relative to the frame and selectively movable in a plane extending perpendicular to the crank axis, wherein the rollers are movable at a user's discretion during rotation of the cranks; and left and right foot supports having first portions rotatably connected to respective cranks, and second portions supported by respective rollers, and third portions sized and configured to support respective feet of a person.

5. The exercise apparatus of claim 4, wherein the rollers are rotatably mounted on respective rocker links which are pivotally mounted on the frame.

6. The exercise apparatus of claim 5, wherein upper ends of the rocker links are sized and configured for grasping.

7. An exercise apparatus, comprising:

a frame sized and configured to rest upon a horizontal floor surface;

left and right cranks rotatably mounted on the frame and rotatable about a common crank axis;

left and right rollers rotatable relative to the frame and selectively movable through parallel paths of motion while in axial alignment with one another; and left and right foot supports having first portions rotatably connected to respective cranks, and second portions supported by respective rollers, and third portions sized and configured to support respective feet of a person.

8. The exercise apparatus of claim 7, wherein the rollers are rotatably mounted on respective rocker links which are pivotally mounted on the frame.

9. The exercise apparatus of claim 8, wherein upper ends of the rocker links are sized and configured for grasping.

* * * * *